US005933168A

United States Patent [19]

Sakai

[11] Patent Number: 5,933,168

[45] Date of Patent: Aug. 3, 1999

[54] RECORDING METHOD BY INK JET RECORDING APPARATUS AND RECORDING HEAD ADAPTED FOR SAID RECORDING METHOD

[75] Inventor: Shinri Sakai, Nagano, Japan

[73] Assignee: Seiko Epson Corporation, Tokyo, Japan

[21] Appl. No.: 08/795,783

[22] Filed: Feb. 5, 1997

[30] Foreign Application Priority Data

Feb. 5, 1996 [JP] Japan ..... 8-019034
Jan. 22, 1997 [JP] Japan ..... 9-023271

[51] Int. Cl.[6] ..... B41J 2/045
[52] U.S. Cl. ..... 347/70; 347/10; 347/71
[58] Field of Search ..... 347/70, 10, 71

[56] References Cited

U.S. PATENT DOCUMENTS

| | | | |
|---|---|---|---|
| 5,521,619 | 5/1996 | Suzuki et al. | 347/10 |
| 5,604,522 | 2/1997 | Miura et al. | 347/70 |
| 5,689,291 | 11/1997 | Tence et al. | 347/70 |
| 5,754,204 | 5/1998 | Kitahara | 347/70 |
| 5,781,203 | 7/1998 | Uriu et al. | 347/10 |

FOREIGN PATENT DOCUMENTS

| | | | |
|---|---|---|---|
| 0271905 | 6/1988 | European Pat. Off. . | |
| 0575204 | 12/1993 | European Pat. Off. . | |
| 0596530 | 5/1994 | European Pat. Off. . | |
| 0648606 | 4/1995 | European Pat. Off. . | |
| 0728583 | 8/1996 | European Pat. Off. . | |
| 4-36071 | 6/1992 | Japan | B41J 2/045 |

OTHER PUBLICATIONS

Patent Abstracts of Japan, publication No. 06297707, application 05087536/1993, published Oct. 1994.

*Primary Examiner*—N. Le
*Assistant Examiner*—Lamson D. Nguyen
*Attorney, Agent, or Firm*—Sughrue, Mion, Zinn, Macpeak & Seas, PLLc

[57] ABSTRACT

A method of jetting drops of ink from a print head, and a print head adapted to the method are described. The drops of ink are stably jet with a size smaller than the nozzle openings. Described is a method in which a meniscus m that is initially stationary at a nozzle opening is rapidly drawn so that a central region mc of the meniscus is strongly drawn toward a pressure producing chamber. When the movement of the central region of the meniscus toward the pressure producing chamber begins to reverse, the pressure producing chamber is caused to contract to produce an inertial stream and causing the inertial stream to act intensively on the central region of the meniscus close to the pressure producing chamber side. As a result, by pushing only the central region of the meniscus at a high speed, an ink droplet whose size is smaller than the diameter of the nozzle opening is jetted out stably at a speed suitable for printing.

16 Claims, 15 Drawing Sheets

FIG. 11III

RECORDING METHOD BY INK JET RECORDING APPARATUS AND RECORDING HEAD ADAPTED FOR SAID RECORDING METHOD

BACKGROUND OF THE INVENTION

1. Field of the invention

This invention pertains to an ink jet recording apparatus having a recording head that jets an ink droplet out of a nozzle opening by displacing a pressure producing chamber by pressure using a piezoelectric vibrator so as to correspond to print data, the pressure producing chamber communicating with the nozzle opening and a reservoir. More specifically, the invention is directed to an ink droplet jetting technique.

2. Related art

An ink jet recording apparatus, such as an ink jet printer, uses an ink jet recording head to form dots on a recording medium, such as paper. In particular, the ink jet recording head forms each dot by jetting an ink droplet out of a nozzle opening of the recording head. The ink droplet is jetted out in response to a drive signal that corresponds to print data and that is supplied to the recording head. The size of the nozzle opening normally sets the size of the ink droplet and, correspondingly, the size of the dot formed on the recording medium. An ink droplet whose size is set in this manner by the size of the nozzle opening may be referred to as a normal size ink droplet.

An ink jet recording head typically includes a pressure producing chamber that communicates with both a nozzle opening and a reservoir, and a pressure producing means that applies pressure to the pressure producing chamber. This type of ink jet recording apparatus can print in full color by using different color inks to form dots of different colors.

To print graphics with photographic quality, it is necessary to make the size of a dot (i.e., the dot size) formed by an ink droplet as small as possible. One way to achieve such a dot size reduction is to reduce the area of the aperture of the nozzle opening. Reducing the size of the nozzle opening decreases the size of a normal size ink droplet, producing a better quality of printing. There is, however, a limitation as to how tiny the nozzle openings can accurately be bored.

A different way of achieving a sufficiently small dot size is proposed in Examined Japanese Patent Publication No. Hei. 4-36071. According to this proposal, a recording apparatus has an ink jet recording head with a vertical vibration mode piezoelectric vibrator as the pressure producing means. This vertical vibration mode piezoelectric vibrator is capable, first, of expanding and, then, of contracting the pressure producing chamber. Using this approach, an ink droplet is produced which has a cross-sectional area that is smaller than the size of the nozzle opening. This effect is due to the kinetic energy of the meniscus, as will now be explained.

According to this proposed approach, the pressure producing chamber first is expanded by the piezoelectric vibrator at a speed higher than during the ink charging operation, so that the meniscus close to the nozzle opening is rapidly sucked, or drawn toward the pressure producing chamber. As a result, a resonance-induced, vertically moving undulation of ink is formed on the surface of the centerline of the meniscus. When the meniscus swells, part of the ink is separated from the meniscus main body and flies, or splashes out of the nozzle opening and onto the recording medium. The thus-created ink droplet has a respective droplet size that is far smaller than that of an ink droplet with a size defined by the nozzle opening (e.g., a normal size ink droplet). Such an ink droplet may be referred to as a reduced size ink droplet. Specifically, an ink droplet whose maximum cross-sectional area ranges from about 10 to 15 $\mu$m can be jetted out of a nozzle opening whose aperture ranges from 51 to 56 $\mu$m. Thus, a reduced size ink droplet whose size is only about 20% the nozzle aperture can be jetted onto the recording medium.

There are disadvantages to the foregoing approach. The size of the reduced size ink droplet so created is so small, compared with the size of the nozzle opening, that many new problems arise. One problem is that a gap is disadvantageously produced between the dots formed by ink droplets that are jetted out of adjacent nozzle openings. Another problem is that, to splash an ink droplet along a predetermined route through a clearance of about 1 to 2 $\mu$m between the nozzle opening and the recording medium, a certain amount of kinetic energy is required. However, the kinetic energy that the reduced size ink droplet can hold is so small that the ink droplet curves, and does not follow the predetermined path. Yet another problem is that the undulations for producing a reduced size ink droplet depend largely on the viscosity of ink, which is temperature dependent. Therefore, the reduced size ink droplet cannot stably be jetted due to the undulations being greatly effected by temperature.

SUMMARY OF THE INVENTION

The invention has been made in view of the aforementioned problems. The object of the invention is to provide a recording method of a recording apparatus using an ink jet recording head that can stably jet an ink droplet whose size is smaller than the size of a mechanical part such as a nozzle opening.

Another object of the invention is to provide an ink jet recording apparatus to which the aforementioned print method is suitably applied.

To overcome the aforementioned problems, the invention is applied to a recording method by an ink jet recording apparatus that involves: the first step of expanding a pressure producing chamber, which communicates with a reservoir through an ink supply port to have ink supplied from the reservoir and jets an ink droplet out of a nozzle opening, in such a manner that a central region of a meniscus in the nozzle opening, rather than a region on a wall surface side of the nozzle opening, is selectively drawn toward the pressure producing chamber by displacing a piezoelectric vibrator; and the second step of contracting the pressure producing chamber at such a speed as to jet an ink droplet by displacing the piezoelectric vibrator.

A meniscus that stays stationary at a nozzle opening is rapidly drawn so that a central region of the meniscus is displaced relatively largely toward a pressure producing chamber. When the movement of the central region of the meniscus toward the pressure producing chamber is reversing, the pressure producing chamber is caused to contract to produce an inertial stream, causing the inertial stream to act intensively on the central region of the meniscus close to the pressure producing chamber side. As a result, by pushing only the central region at a high speed, an ink droplet whose size is smaller than the diameter of the nozzle opening is jetted stably at a speed suitable for printing.

DESCRIPTION OF THE PREFERRED EMBODIMENTS

Figure 1:
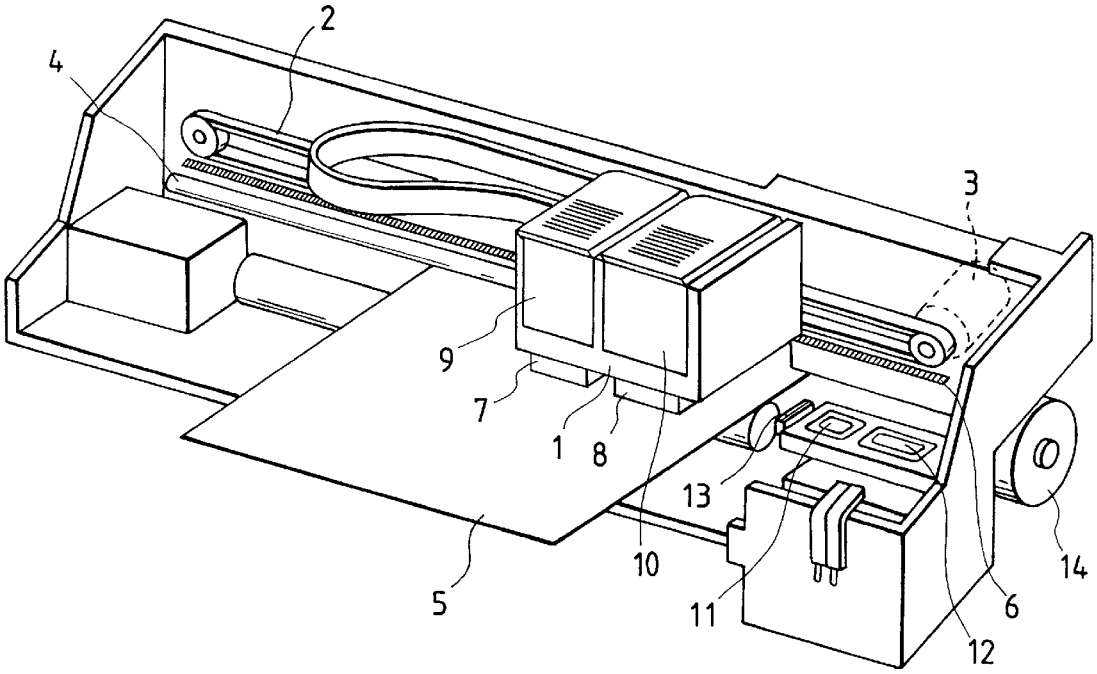
FIG. 1 is a diagram showing an embodiment of an ink jet recording apparatus of the invention highlighting a recording mechanism thereof.

Details of the invention will now be described with reference to the exemplary embodiments shown in the drawings.

FIG. 1 shows the structure of a print mechanism in a printer according to the invention. In FIG. 1, reference numeral 1 denotes a carriage, which is connected to a carriage drive motor 3 through a timing belt 2, and which shuttles across the width of a recording sheet 5 while guided by a guide member 4. The position of the carriage 1 can be detected by a linear encoder 6.

The carriage 1 has ink jet recording heads 7, 8. These heads are attached to a surface of the carriage 1 confronting the recording sheet 5, i.e., to the lower surface of the carriage 1 in this embodiment. With ink replenished from ink cartridges 9, 10 mounted on the carriage 1, images and characters are printed on the recording sheet 5 by forming dots on the recording sheet 5 with ink droplets being jetted so as to match movement of the carriage 1.

Further, in a non-printing region, cap members 11, 12 are arranged. The cap members 11, 12 not only seal the nozzle openings of the recording heads 7, 8 while stopped, but also receive ink droplets jetted from the recording heads 7, 8 due to a flashing operation that is performed during the printing operation. It may be noted that reference numeral 13 denotes a cleaning means and reference numeral 14 a sheet forward motor.

Figure 2:
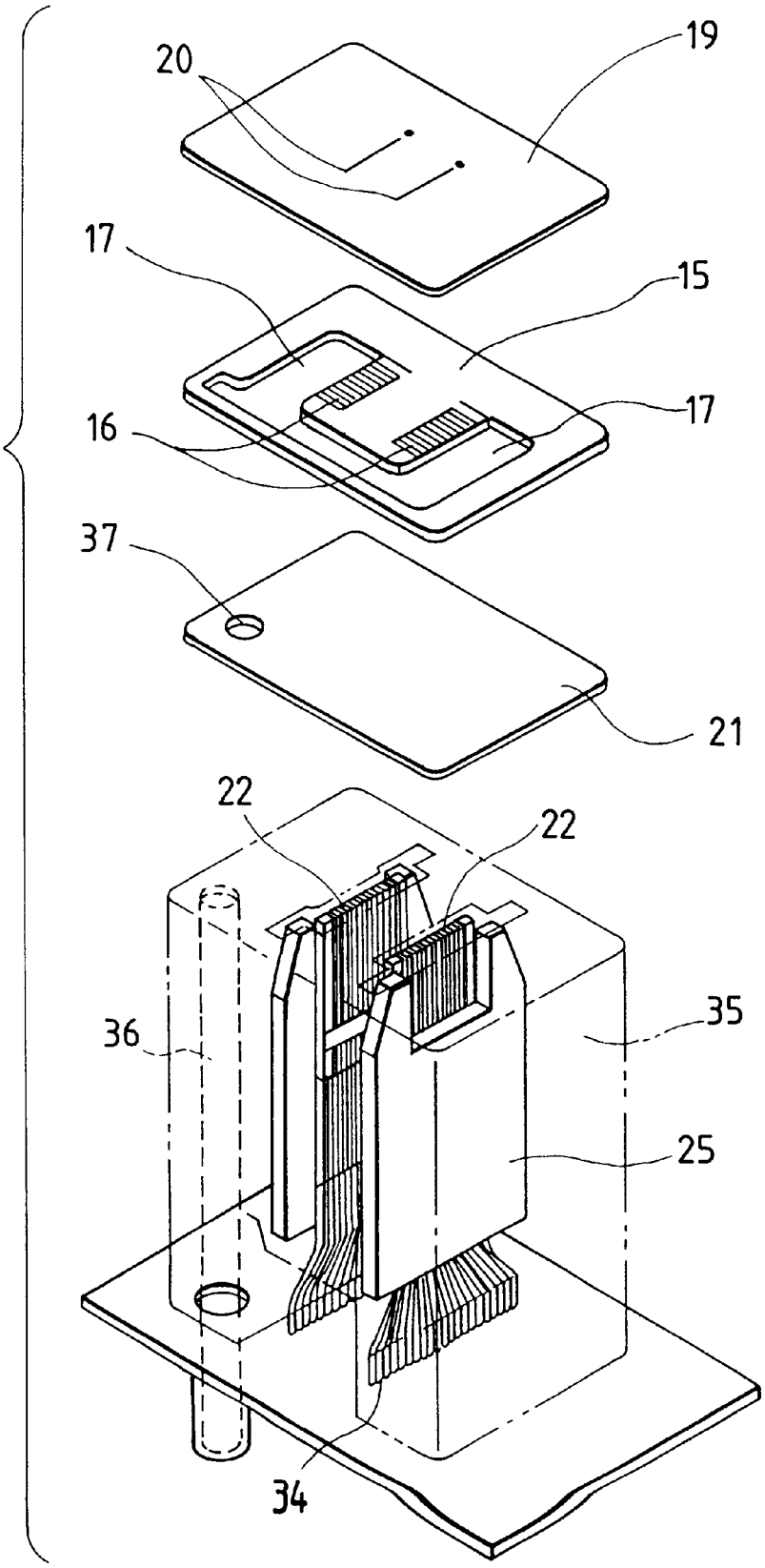
FIG. 2 is a perspective view for assembly showing an embodiment of a recording head of the aforementioned apparatus.

FIG. 2 shows an embodiment of the recording heads 7, 8. In FIG. 2, reference numeral 15 denotes a passage forming board. In the central region of the passage forming board 15, a plurality of arrays of pressure producing chambers 16, 16, . . . are formed so as to match an interval at which the nozzle openings 20, which will be described later, are pitched. Around the pressure producing chambers 16 are reservoirs 17 and ink supply ports 18 (see FIG. 3). The reservoirs 17 supply ink to the pressure producing chambers 16 via the ink supply ports 18. In other words, the ink supply ports communicate with and connect the pressure producing chambers 16 to the reservoirs 17.

A nozzle plate 19 that seals one opening surface of the passage forming board 15 has, in the central region thereof, the nozzle openings 20 formed so as to confront ends of the corresponding pressure producing chambers 16. That is, the pressure producing chambers 16 each have two ends. One end is the end that confronts the nozzle opening 20 of the pressure producing chamber, and may be referred to as the nozzle end of the pressure producing chamber. The other end is the end that connects with the ink supply port 18 of the pressure producing chamber, and may be referred to as the ink supply port end of the pressure producing chamber.

Figure 5:
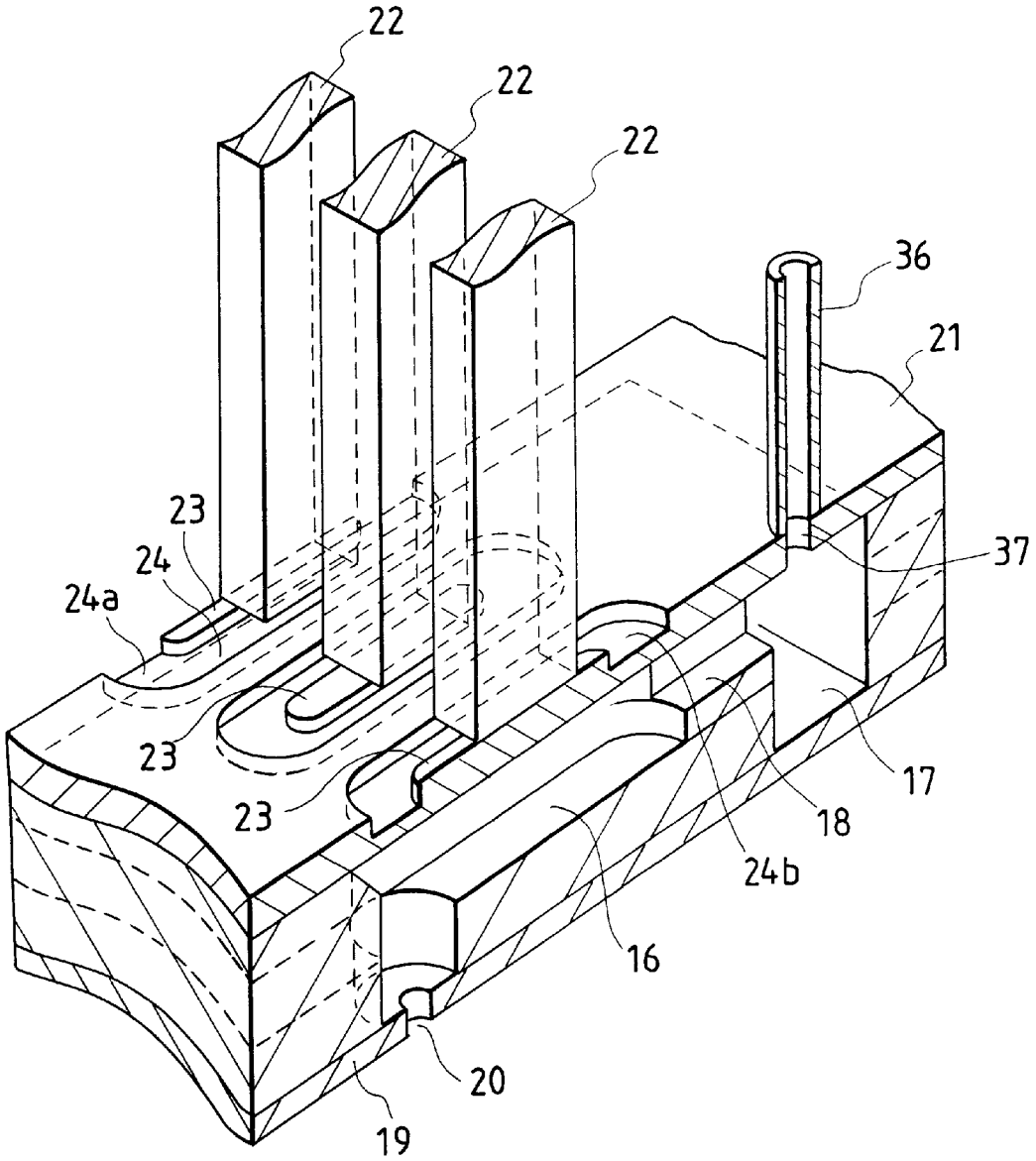
FIG. 5 is a perspective view showing the neighborhood of a pressure producing chamber of the aforementioned recording head in enlarged form.
Figure 6:
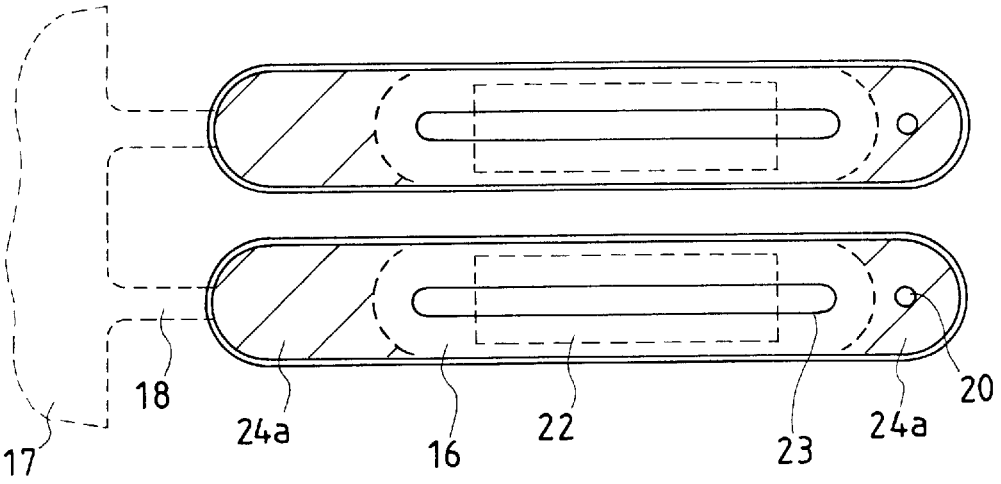
FIG. 6 is a diagram showing a structure of an elastic plate that seals pressure producing chambers of the aforementioned recording head.

An elastic plate 21 seals the other opening surface of the passage forming board 15. The elastic plate has an island portion 23 and a thin-walled portion 24 formed in the central region of each pressure producing chamber 16 (see FIG. 3). The island portion 23 has relatively large rigidity and efficiently transmits a displacement of a piezoelectric vibrator 22, which will be described later, to a corresponding pressure producing chamber 16 while abutted against the piezoelectric vibrator 22. The thin-walled portion 24 is elastically deformable and is formed so as to surround the island portion 23. As shown in FIG. 5, the thin-walled portion 24 is formed not only on both sides of the island portion 23 but also on regions 24*a*, 24*b* on the nozzle opening side and the ink supply port side, so that compliance is positively given to the vicinity of the corresponding nozzle opening and to the vicinity of the corresponding ink supply port.

Figure 4:
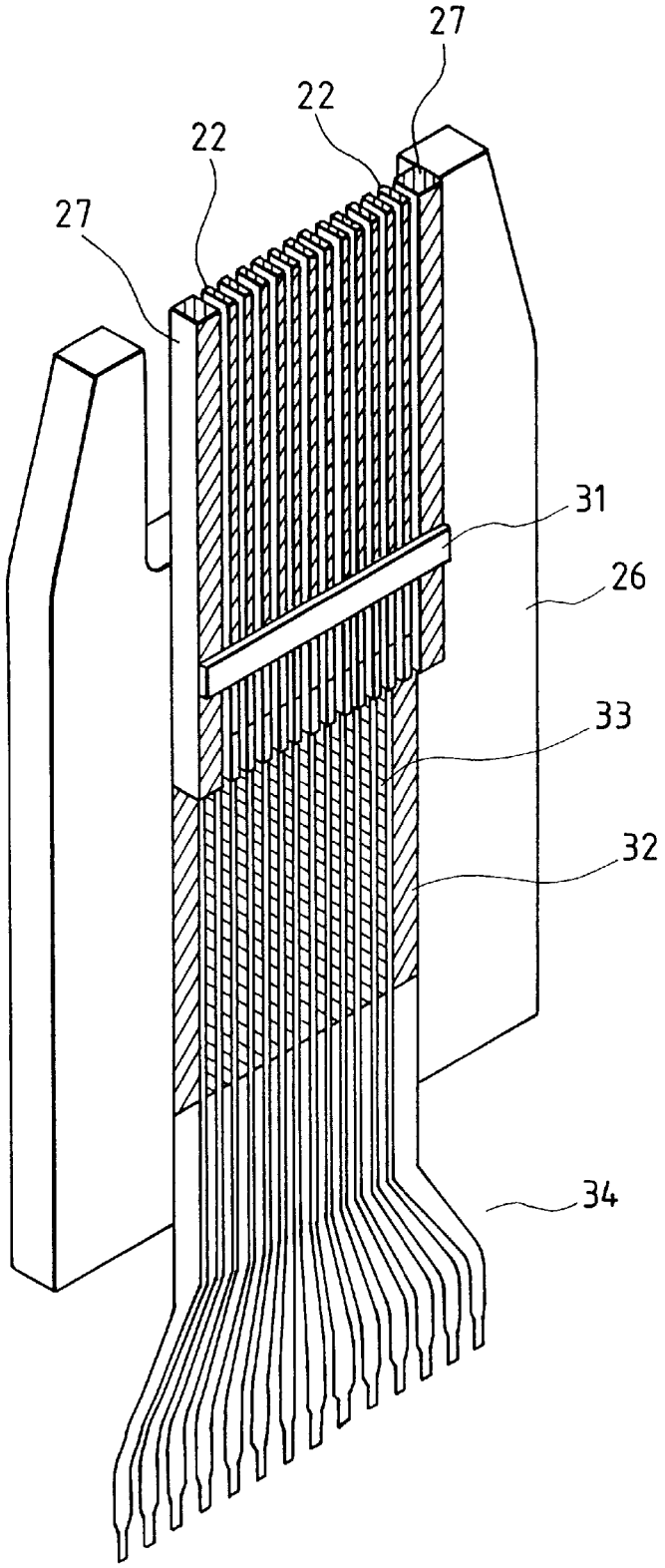
FIG. 4 is a diagram showing an embodiment of a piezoelectric vibrator unit used for the aforementioned recording head.

Reference numeral 25 denotes a piezoelectric vibrator unit. As shown in FIG. 4, the piezoelectric vibrator unit 25 has one end thereof fixed to a fixing board 26 made of a highly rigid material such as metal and ceramic and has a plurality of piezoelectric vibrators 22 arranged thereon so as to match the interval at which the pressure producing chambers 16 are pitched. On both ends of the unit 25 are dummy piezoelectric vibrators 27, 27 that function as positioning members and conductive pattern forming members.

Each of these piezoelectric vibrators 22 is designed so that a plurality of electrodes 29, 30 (see FIG. 3) interpose a piezoelectric material 28 such as lead titanate zirconate, and the thus-constructed piezoelectric vibrators 22 overlap one upon another in a region other than the vicinity of both ends of the piezoelectric vibrator unit 25 (see FIG. 1). That is, it is designed so that the region where the electrodes 29, 30 overlap is an active region, i.e., a region that takes part in the expanding and the contracting of the piezoelectric vibrators 22 in the axial direction.

Figure 3:
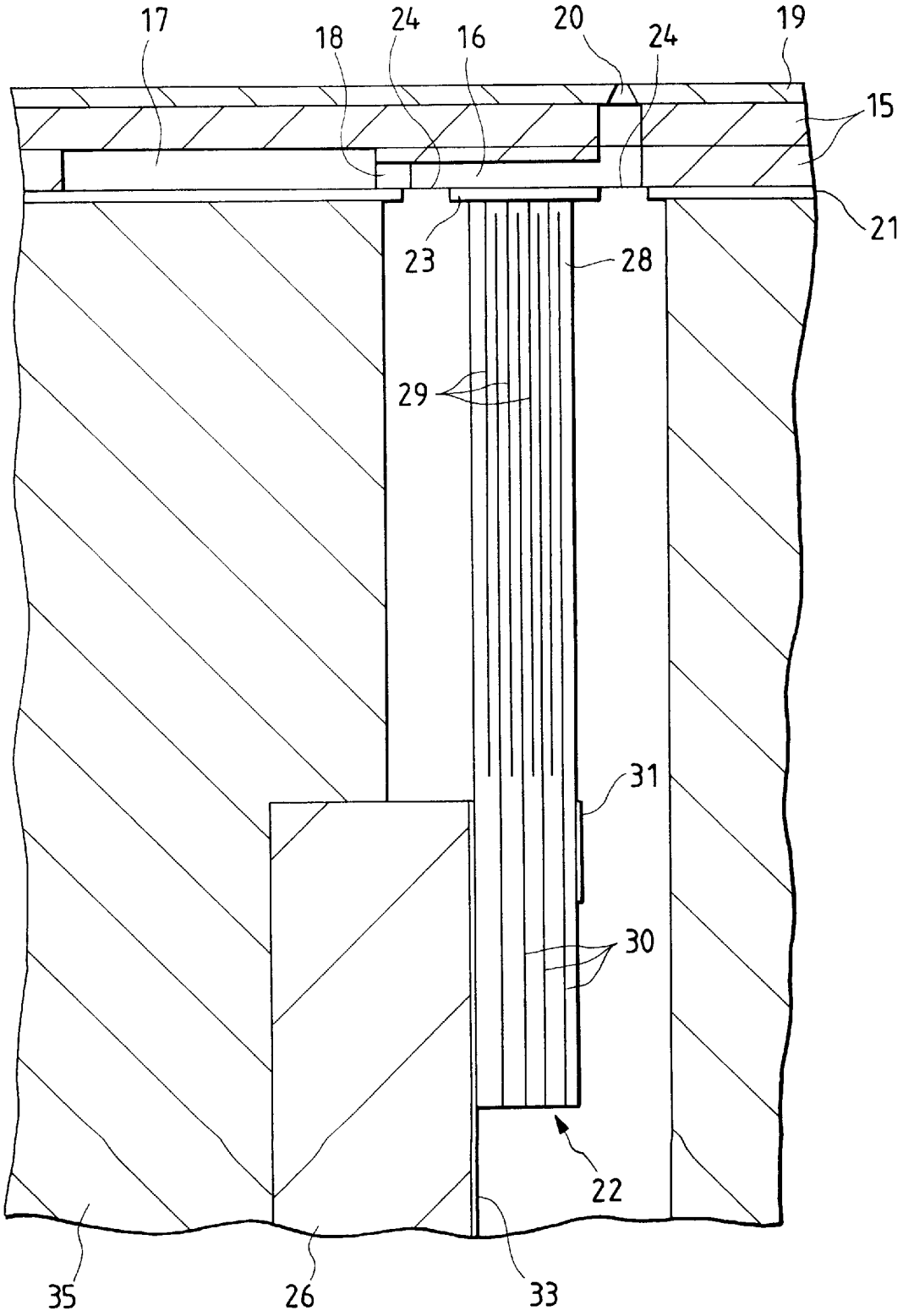
FIG. 3 is a diagram showing a cross-sectional structure of the aforementioned recording head highlighting a single pressure producing chamber.

The electrodes 29 are connected in parallel to one another, between the respective piezoelectric vibrators, by a connecting bar 31 (see FIGS. 3 and 4). The connecting bar 31 couples the electrodes 29 to conductive patterns formed on dummy vibrators 27 which, in turn, are further coupled to conductive patterns 32. Thus, an electrical connection extends from electrodes 29 to conductive patterns 32 which are formed on a surface of the fixing board 26.

The electrodes 30, on the other hand, are connected to respective ones of the conductive patterns 33. The electrodes 30 are not connected in parallel like the electrodes 29, and thus are independent from each other per piezoelectric vibrator. That is, the electrodes 30 of each piezoelectric vibrator are independent from the electrodes 30 of the other piezoelectric vibrators.

The electrodes 29, 30 are thus respectively coupled through conductive patterns 32, 33 to a lead frame 34, and further on to a drive circuit, which will be described later.

Referring again to FIG. 2, the nozzle plate 19, the passage forming board 15, and the elastic plate 21 are laminated one upon another to be integrated into a passage unit. The thus-formed passage unit is fixed to an opening of a head frame 35 made of a high molecular material or the like.

The tips of the respective piezoelectric vibrators 22 of the piezoelectric vibrator unit 25 are firmly fixed to the corresponding island portions 23 (see FIG. 5) with an adhesive. The fixing plate 26 (see FIGS. 3 and 4) of the piezoelectric vibrator unit 25 is fixed to the head frame 35 with an adhesive. By so fixing the foregoing parts, a recording head is assembled. As shown in FIGS. 2 and 5, an tube 36 is set into the head frame 35, and is connected to an ink tank (not shown) supplied by an ink cartridge 9, 10. The front end of the ink tube 36 is connected to an ink introducing port 37 (see FIG. 1) formed in the elastic plate 21. As a result, ink can be supplied to the reservoirs 17 from outside.

Characteristics of the thus-constructed ink jet recording head will be described next.

When accelerated ink flows through a thin passage, the mass of the ink acts as inertance. The inertance M can be expressed as follows, assuming that ink density is p, and that the cross-sectional area and length of the passage are S, L, respectively:

$$M = \kappa \frac{\rho L}{S}$$

where κ is the coefficient of shape determined by the cross section of the passage. If the cross-section is a circle, or is circular and the ratio of the perpendicularly crossing diameters is about 1, then the coefficient κ is about 1.3.

The inertance of a given pressure-producing chamber may be referred to as Mc, the inertance of a given nozzle opening as Mn, and the inertance of a given ink supply port as Ms.

A pressure producing chamber has a particular compliance. The compliance C of a pressure producing chamber 16 is derived from a compliance component Cink produced by the compressibility of the ink.

The component Cink is expressed as follows:

$$C_{ink} = \kappa' V_{ink}$$

where:

κ' is the volume compressibility of the ink, which is about 0.45 (GPa)—1 for aqueous ink; and Vink is the capacity of the pressure producing chamber 16.

Further, since the pressure producing chamber 16 is surrounded by an elastic member, elastic deformations also act as compliance. However, since these elastic deformations depend largely on the shape, and further since the pressure producing chamber has a complicated shape, the component Cink is usually calculated experimentally by a finite element method or the like.

Recall that the thin-walled portions 24*a* are on the nozzle opening side of the islands 23, and that the thin-walled portions 24*b* are on the ink supply port side of the islands 23 (see FIG. 5). The thin-walled portions 24*a* may be referred to as nozzle opening side thin-walled portions, and the thin-walled portions 24*b* may be referred to as ink supply port side thin-walled portions.

The ink jet recording head in this embodiment is designed so that the thin-walled portions 24*a*, 24*b* are remote, or spaced from the region pressured by the piezoelectric vibrator 22. That is, the nozzle opening side thin-walled portions 24*a* are not directly under the tips of the piezoelectric vibrators 22, and neither are the ink supply port side thin-walled portions 24*b*.

The pressure producing chambers 16, ink supply ports 18, and nozzle openings 20 are set so that the values of Mc and Ms are larger than the value of Mn.

That is, the nozzle opening 20 has an aperture of 32 μm and a straight portion length of 15 μm, and has a tapered portion on the straight portion, so that the inertance Mn is set to $8\times10^7$ (kg/m$^4$). The ink supply port 18 has a rectangular cross section of 40 μm×50 μm and has a length of 300 μm, so that the inertance Ms thereof is $21\times10^7$ (kg/m$^4$). Further, the pressure producing chamber 16 has a rectangular cross section of 40 μm×100 μm and has a length of 500 μm, so that the inertance Mc thereof is $25\times10^7$ (kg/m$^4$). Thus, Mc and Ms are larger than Mn.

On the other hand, with respect to compliance, a component Cc1 derived from the thin-walled portion 24*a* on the nozzle opening side is Cc1_$4\times10^{-21}$ (m$^3$/Pa) and a component Cc2 derived from the thin-walled portion 24*b* on the ink supply port side is Cc2=$8\times10^{-21}$ (m$^3$/Pa).

As a useful analysis too, the displacement of a piezoelectric vibrator on a pressure producing chamber, and the resulting ink stream, may be analogized to an electric circuit. To point out a key aspect of the invention, the above-described ink jet recording head will now be analyzed using this electrical circuit analogy.

Figure 7A:
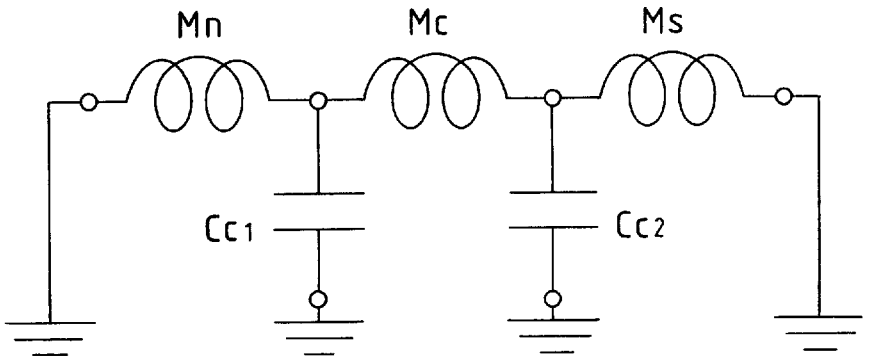
FIG. 7 includes diagrams 7(*a*) and 7(*b*) respectively showing fluid characteristics of the aforementioned recording head in the form of a model.
Figure 7B:
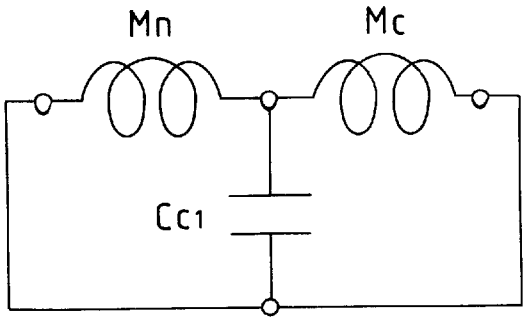

Under this analysis, the ink jet recording head is like a series circuit in which inertances Mn, Mc, Ms of a nozzle opening 20, a pressure producing chamber 16, and an ink supply port 18 are connected in series with one another, and a circuit in which the compliance Cc1 derived from the thin-walled portion 24*a* on the nozzle opening side and the compliance Cc2 derived from the thin-walled portion 24*b* on the ink supply port side are connected to the nodes of the respective inertances as shown in FIG. 7(*a*) in static terms.

It is important to note that, when the time for displacement of a piezoelectric vibrator 22 is long, both the nozzle opening side thin-walled portion 25*a* and the ink supply port side thin-walled portion 24*b* vibrate (see FIG. 5). Therefore, both the compliances Cc1, Cc2 on the nozzle opening side and on the ink supply port side function as compliance upon the fluid circuit as a whole. Since the Helmholtz resonance frequency is 160 kHz in this vibration mode, a meniscus of the ink has a natural vibration cycle of 6 μs.

On the other hand, when the time for compressive displacement of a piezoelectric vibrator 22 is short, only the nozzle opening side thin-walled portion 24*a* vibrates. Therefore, an ink stream produced with only the nozzle opening side thin-walled portion 24*a* vibrating is subject to the compliance Cc2 on the ink supply port side that is made larger than the compliance Cc1 derived from the thin-walled portion 24*a*. Hence, on the ink supply port side, the majority of the ink stream is absorbed by the compliance Cc2.

Therefore, the electrical circuit shown in FIG. 7(*a*), when the ink supply side thin-walled portion 24*b* does not vibrate, becomes equivalent to a circuit shown in FIG. 7(*b*). That is, with the supply port side of the pressure producing chamber 16 short-circuited, the compliance Cc1 on the nozzle opening side is connected to the nodes of a series circuit consisting of the inertance Mc of the pressure producing chamber 16 and the inertance Mn of the nozzle opening 20. Since the Helmholtz resonance frequency in this vibration mode is 320 kHz, a meniscus of the ink has a natural vibration cycle of 3 μs.

As a result, an ink stream produced by expansion and contraction of the pressure producing chamber 16 by the piezoelectric vibrator 22 makes a movement in which two vibration modes whose natural vibration cycles are 6 μs and 3 μs have been synthesized. Thus, two vibration modes are defined, and when the capacity of a pressure producing chamber 16 is varied at a cycle shorter than the cycles of these two vibration modes, i.e., 3 μs or less in this embodiment, then a movement corresponding to the two vibration modes can be made upon the meniscus.

The piezoelectric vibrator 22 used for the recording head of this embodiment is 1.5 μm long and has a natural vibration frequency in the axial direction of 450 kHz and a cycle of 2.2 μs. Further, utilizing displacement in the axial direction, the piezoelectric vibrator 22 has extremely large rigidity compared with a piezoelectric vibrator that uses flexural vibration, the rigidity thereof being 10 times or more that of the island portion 23 of the pressure producing chamber 16. Therefore, the displacement of the piezoelectric vibrator 22 can be transmitted to the pressure producing chamber 16 without a time lag. As a result, a peak of vibration of the meniscus has been observed in a frequency range lower than the natural vibration frequency of the piezoelectric vibrator 22.

Figure 8:
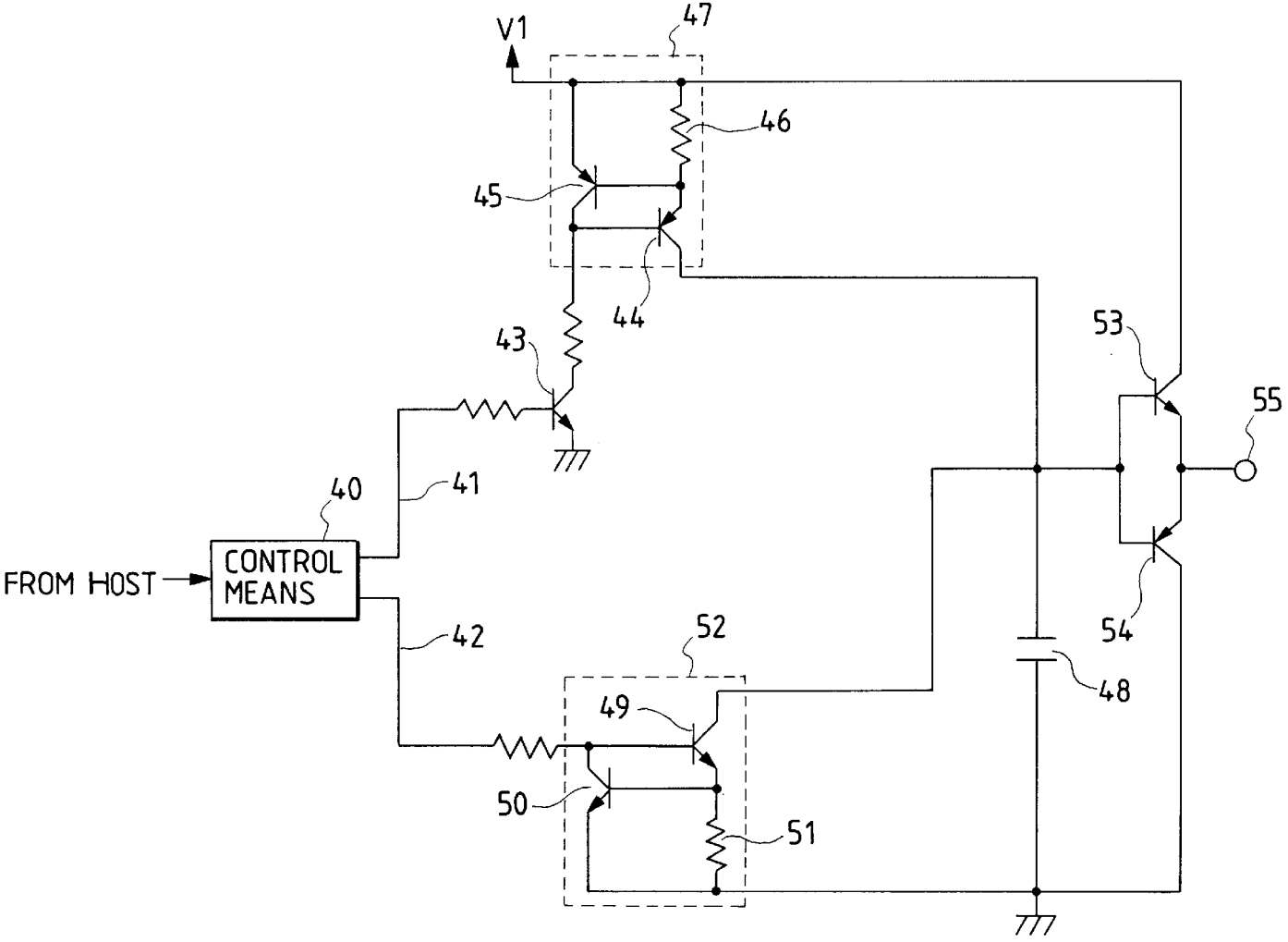
FIG. 8 is a circuit diagram showing an embodiment of a drive unit that drives the aforementioned recording head.

FIG. 8 shows an embodiment of a drive unit that drives the aforementioned recording head. In FIG. 8, reference numeral 40 denotes a control means, which is designed to output a charge pulse (FIG. 9(II)) and a discharge pulse (FIG. 9(III)) from output terminals 41, 42 in synchronism with a print signal (FIG. 9(I)) from a host.

When a charge pulse is applied to the base of an NPN transistor 43 to cause the NPN transistor 43 to conduct, a constant current circuit 47 having PNP transistors 44, 45 and a resistor 46 operates, thereby charging a capacitor 48 to a voltage V1 at a predetermined current Ira suitable for sucking, or drawing a meniscus.

On the other hand, when a discharge pulse is applied to the input terminal 42, a constant current circuit 52 having NPN transistors 49, 50 and a resistor 51 discharges the charges stored in the capacitor 48 to a zero voltage at a predetermined current Ifa. It may be noted that NPN transistors denoted as reference numerals 53, 54 constitute a current amplifier and applies a current suitable for driving a piezoelectric vibrator 22 to an output terminal 55.

An operation of the thus constructed apparatus will be described next.

First, the behavior of a fluid when a vibrating pressure gradient a is given to a fluid loaded either into a conduit having such a narrow gap as a nozzle opening or between two parallelly arranged plates will be outlined (see "Fluid Dynamics" (Part I), Isao Imai, Shokabo Publishing Co., Ltd.)

$$\alpha = P\cos(\omega\iota)$$

Figure 10:
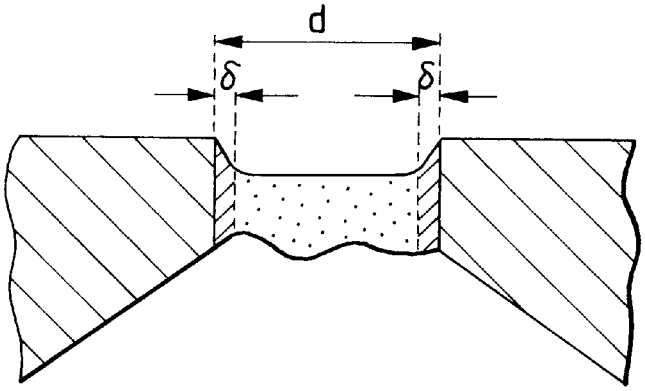
FIG. 10 is a diagram showing a range of two different fluid characteristics produced in the vicinity of a nozzle opening by a drive method of the invention.

Assuming that pressure vibration is P; angular frequency of pressure vibration is ω; the diameter of a conduit if a passage is formed of a conduit is d; and a kinematic viscosity coefficient of a fluid is υ, if the following condition:

$$\left(\frac{\nu}{\omega}\right)^{\frac{1}{2}} \ll \frac{d}{2}$$

is established, the fluid is viscous within the range of a predetermined thickness δ from the conduit wall as shown in FIG. 10 so that a stream having the same phase with the pressure gradient is produced, whereas in a region outside the boundary layer, i.e., in a region closer toward the center as viewed in FIG. 10, the stream is subject to a time-dependent change in pressure gradient, i.e., the stream has a phase π/2 behind the phase of the vibration although the stream vibrates as a single body while largely affected by inertia.

The thickness δ of the region where the fluid is largely viscous is expressed as follows from the conduit wall.

For example, assuming that the diameter of a conduit is 30 μm; dynamic viscosity coefficient of ink υ is $2\times10^{-6}m^2/s$; and the natural cycle of pressure vibration is 10 μs, then the thickness δ of the boundary layer becomes about 2.5 μm.

Figure 9:
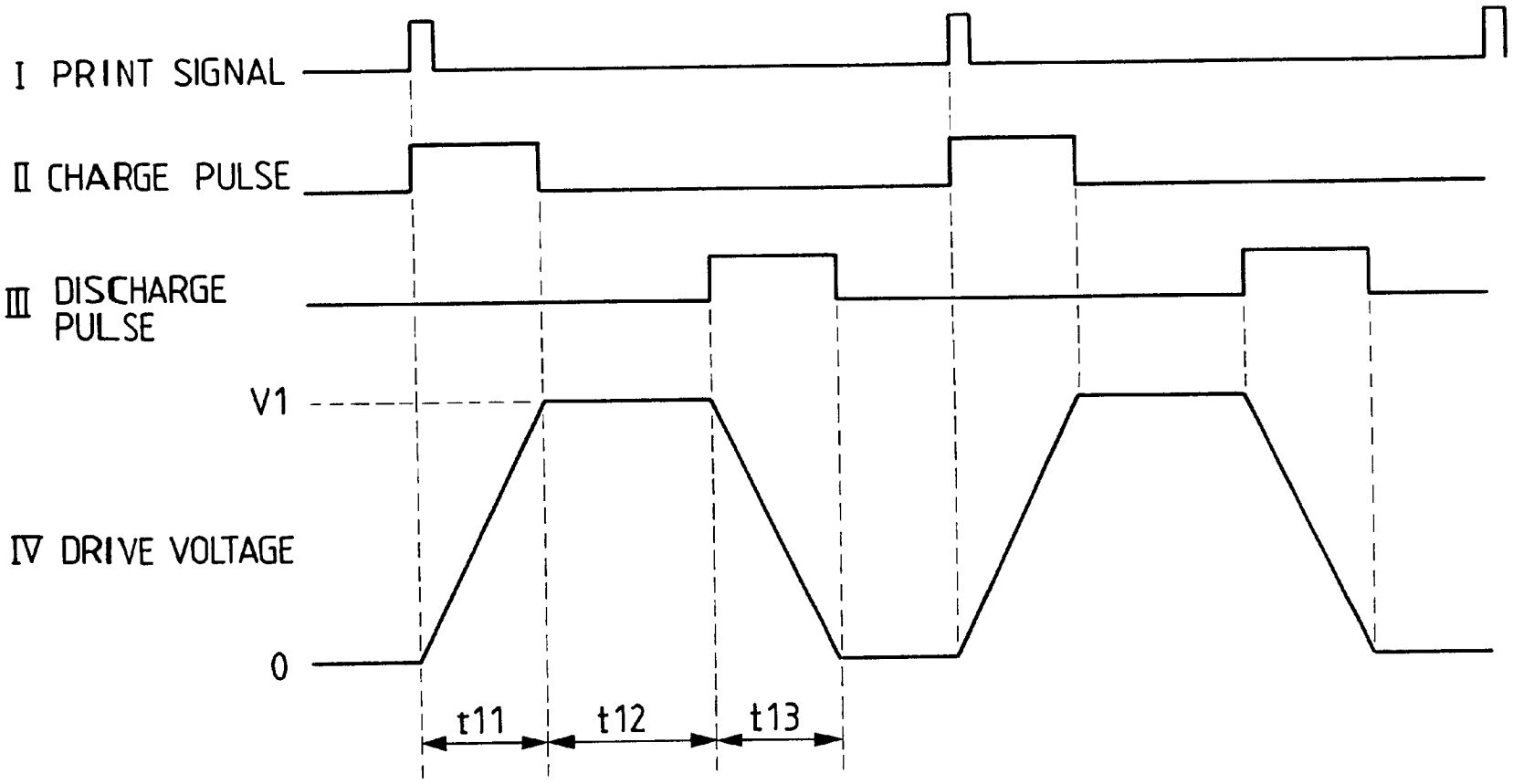
FIG. 9 is a waveform diagram showing signals of the aforementioned drive unit.

When a print command is applied to the control means 40 from the host, the control means 40 outputs a charge signal (FIG. 9(II)) whose time width is t11 to the terminal 41 in synchronism with a print signal (FIG. 9(I)). The piezoelectric vibrator 22 is rapidly charged to the voltage VI at a predetermined gradient for the time t11 at the predetermined current Ira supplied by the constant current circuit 47, so that the piezoelectric vibrator 22 contracts at a predetermined speed. As a result, the corresponding pressure producing chamber 16 rapidly expands, so that out of the meniscus m stationary at the nozzle opening 20 (FIG. 11(I)), a meniscus portion closer to the central region is radically drawn toward the pressure producing chamber relatively more largely than the region having the thickness δ from the wall surface of the nozzle opening 20 in which the ink is largely viscous.

The control means 40 holds the voltage V1 for a time t12 at the stage where the piezoelectric vibrator 22 has been charged to the voltage V1, and prevents capacity change of the pressure producing chamber 16 to a possible extent. On the other hand, the meniscus thereafter moves further toward the pressure producing chamber in accordance with the natural vibration cycle of its own. However, during this process, an outward stream (arrows A as viewed in FIG. 11(III)) is produced in the vicinity of the boundary layer, whereas the central region of the meniscus is still drawn toward the pressure producing chamber (FIG. 11(III)).

As time elapses, the meniscus is transformed in such a manner that the central portion thereof is more largely displaced toward the pressure producing chamber with the boundary layer portion pushed out toward the nozzle opening. Further, in the central region of the nozzle opening 20, the inertance is relatively small compared with the boundary layer because of the smaller amount of ink, so that only the central region of the nozzle opening 20 is selectively drawn toward the pressure producing chamber rapidly (FIG. 11(IV).

Thus, at the stage where the central region of the meniscus m is largely drawn toward the pressure producing chamber, the control means 40 outputs a discharge pulse (FIG. 9(III)) from the terminal 42. The piezoelectric vibrator 22 is discharged for a time t13 at the predetermined current Ifa from the constant current circuit 52, so that the piezoelectric vibrator 22 radically expands to thereby contract the pressure producing chamber 16 at a predetermined speed.

Figure 11I:
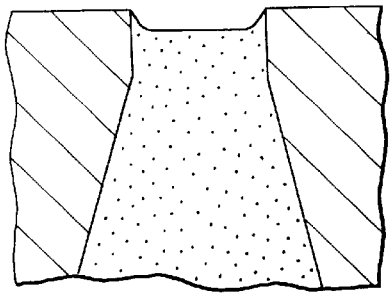
FIG. 11 includes diagrams 11(I) to 11(VI) schematically showing movements of a meniscus produced by the drive method of the invention.
Figure 11I:
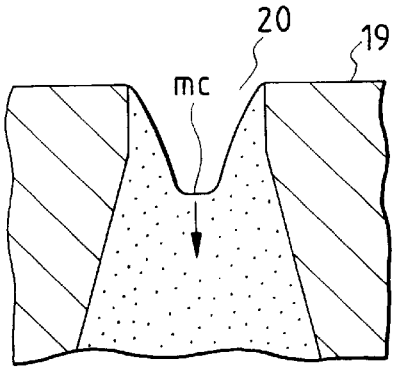
Figure 11I:
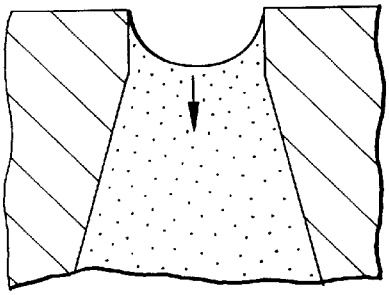
Figure 11V:
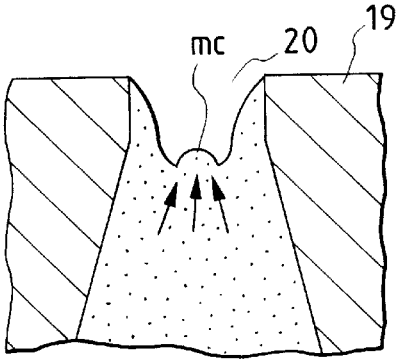
Figure 11V:
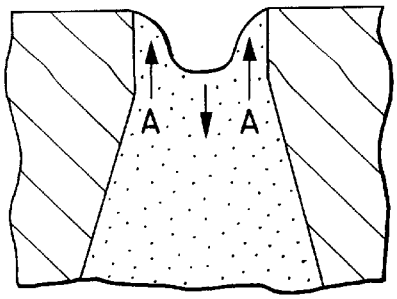
Figure 11V:
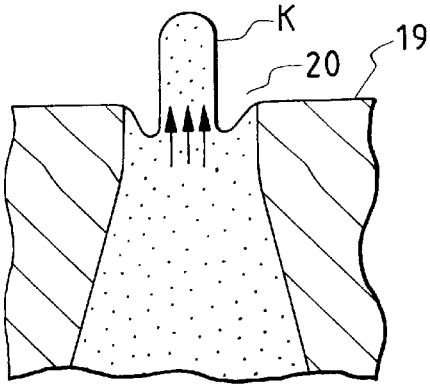

An ink stream pressured by the pressure producing chamber 16 due to the contraction of the pressure producing chamber 16, i.e., an inertial stream acts upon the central region mc of the meniscus m close to the pressure producing chamber side intensively (FIG. 11(V)), pushing only the central region mc of the meniscus m out selectively at a very high speed (FIG. 11(VI)). Since the central region of the meniscus is positively pressured without recourse solely to the movement of the meniscus itself this way, a slender ink droplet whose diameter is smaller than the diameter of the nozzle opening 20 can be jetted out of the nozzle opening 20 stably at a speed suitable for printing.

Then, at the stage where the voltage of the piezoelectric vibrator 22 is zeroed, a next print signal is waited for, and every time a print signal is inputted, the aforementioned process is repeated so that dots are formed.

Figure 12:
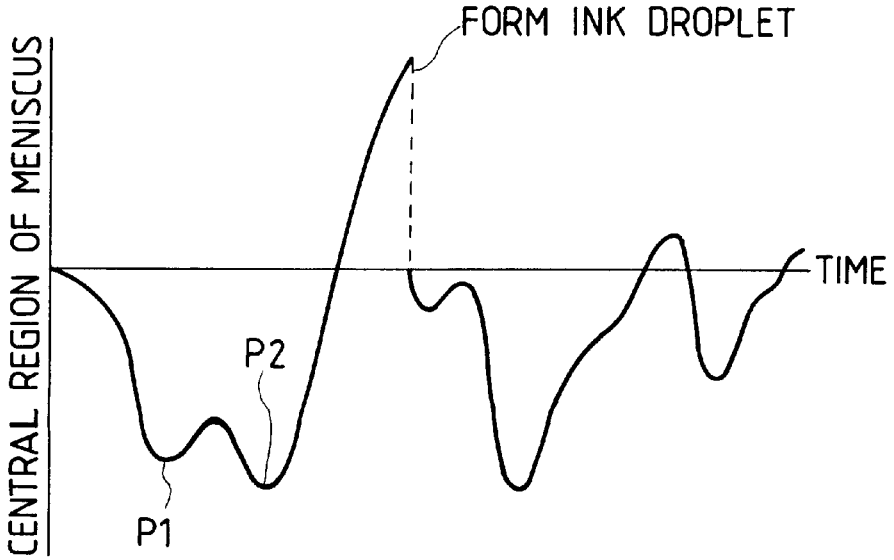
FIG. 12 is a diagram showing a time-dependent change in the central position of a meniscus by the drive method of the invention.

The aforementioned operation will be described in more detail with reference to FIG. 12, highlighting the movements of the meniscus.

When the pressure producing chamber 16 expands radically in the first step, a meniscus portion close to the nozzle opening 20 is drawn toward the pressure producing chamber by the vibration mode derived from superposition of the two vibration modes as described above, and the meniscus repeats a movement toward the pressure producing chamber and a movement toward the nozzle opening at the respective natural vibration cycles, i.e., at 3 $\mu$s and 6 $\mu$s.

The meniscus is excited with the two vibration modes superimposed, the two vibration modes existing as the characteristics of the recording head. Therefore, when the meniscus is drawn toward the pressure producing chamber, a return (P1) of the meniscus caused by a vibration of short cycle (3 $\mu$s) is started and the meniscus is thereafter drawn toward the pressure producing chamber again, finally reaching the maximum depth (P2). Since a vibration of long cycle (6 $\mu$s) is also superimposed at point P2, vibrations in the two modes are in the same phase with each other, allowing the meniscus to start returning rapidly toward the nozzle opening 20. Therefore, if a discharge pulse (FIG. 9(III)) is outputted so as to match this timing to thereby cause the pressure producing chamber 16 to contract rapidly, an ink droplet k (FIG. 11) having such a small cross section, as described above, can be jetted out at a higher speed.

The ink jet recording head according to this embodiment is characterized in that the vibration of the whole meniscus is dominated by two vibrations whose vibration cycles are different, and these cycles are set to multiples of an integer such as 3 $\mu$s and 6 $\mu$s. Therefore, the vibrating components of the meniscus formed by the two modes are brought into phase with each other from the time the meniscus returns toward the nozzle opening for the second time, i.e., from when the meniscus has reached the maximum depth (P2), to the ink jetting timing. As a result, the meniscus is efficiently accelerated toward the nozzle opening.

Thus, with respect to the drive voltage (FIG. 9(IV)), the sum of the charge time t11 and the hold time t12 (that is, t11+t12) is set so as to coincide with the timing at which the meniscus reaches the maximum vibration (P2), and the expansion time of the piezoelectric vibrator 22, i.e., the discharge time t13, is set either to a time shorter than the shorter cycle of the vibration mode, i.e., 3 $\mu$s in this embodiment, or preferably so as to coincide with the shorter cycle of the vibration mode, so that occurrence of residual vibrations can be prevented.

As a result of this drive method, in the recording head of the invention, an ink droplet whose weight is from 3 $\mu$g to 8 $\mu$g is jetted at a speed of from 5 m/s to 10 m/s. In other words, a very small droplet is jetted at a very high speed. According to the ordinary method described in the above description of the related art, to achieve this high of a jetting speed, the ink droplet could be reduced by only 60 to 80% of the normal size ink droplet.

Description will now be made of an experimental verification of the advantages of the foregoing invention. To verify the timing for causing the pressure producing chamber 16 to contract to jet an ink droplet, a similar experiment was conducted by preparing an experimental verification ink jet recording head under the following conditions. Only the compliance Cc2 on the ink supply port side is set to $14\times10^{-21}$ ($m^3$/Pa), which is about twice that of the aforementioned embodiment. The natural vibration cycle of a meniscus derived from the thin-walled portion 24*a* on the nozzle opening side is set to 3 $\mu$s, and the natural vibration cycle of the meniscus derived from the thin-walled portion 24*b* on the nozzle opening side is set to as large as 8 $\mu$s.

In this experimental verification ink jet recording head, therefore, one vibration cycle is 3 $\mu$s, and the other is 8 $\mu$s.

Figure 13A:
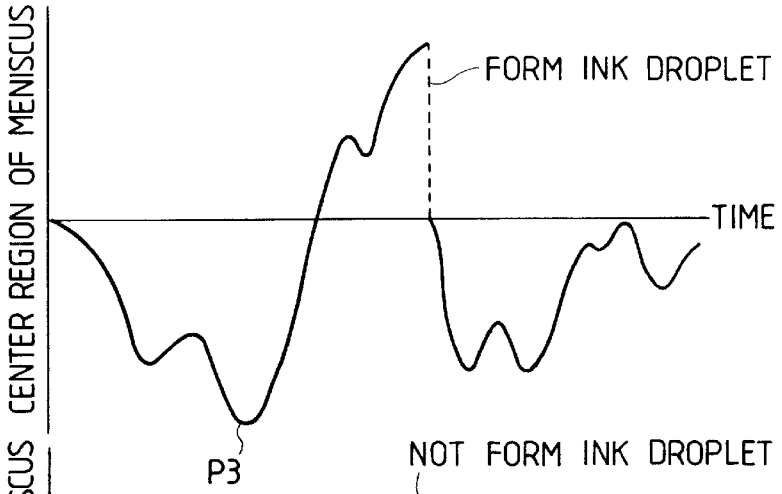
FIG. 13 includes diagrams 13(*a*) and 13(*b*) respectively showing time-dependent changes in the central position of a meniscus as comparative examples.
Figure 13B:
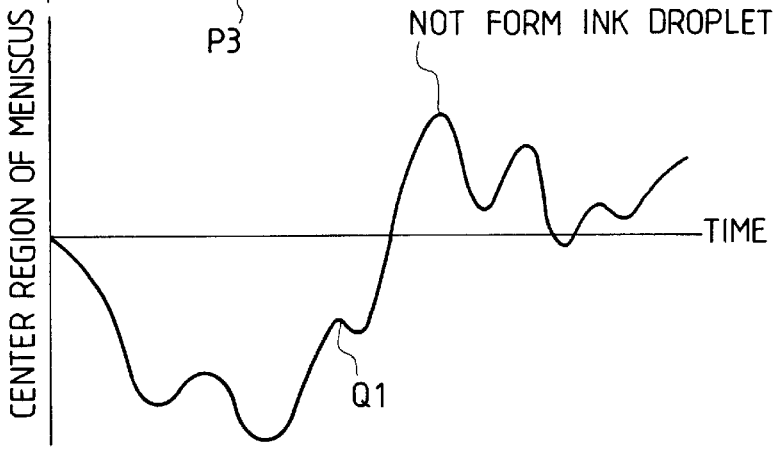

FIG. 13(*a*) shows the result when a pressure producing chamber 16 of the experimental verification ink jet recording head was caused to contract rapidly in a manner similar to the invention, so as to match a timing P3 at which the meniscus moves toward the nozzle opening for the second time. The result in this instance is that an ink droplet having a cross sectional area smaller than the diameter of the nozzle opening 20 was jetted at a high speed suitable for printing, and in a manner similar to the above invention.

FIG. 13(*b*) shows the result when the pressure producing chamber 16 of the experimental verification ink jet recording head was caused to contract so as to match a timing Q1. Timing Q1 represents a timing at which a low-frequency component derived from the ink supply port side thin-walled portion 24*b* returns (recall that the compliance of 24*b* was increased). Such a contraction only accelerated the movement of the meniscus, and did not contribute to forming an ink droplet.

As the results in FIGS. 13(*a*) and 13(*b*) show, the jetting of ink droplets in the experimental verification ink jet recording head is not a stable operation.

Figure 14:
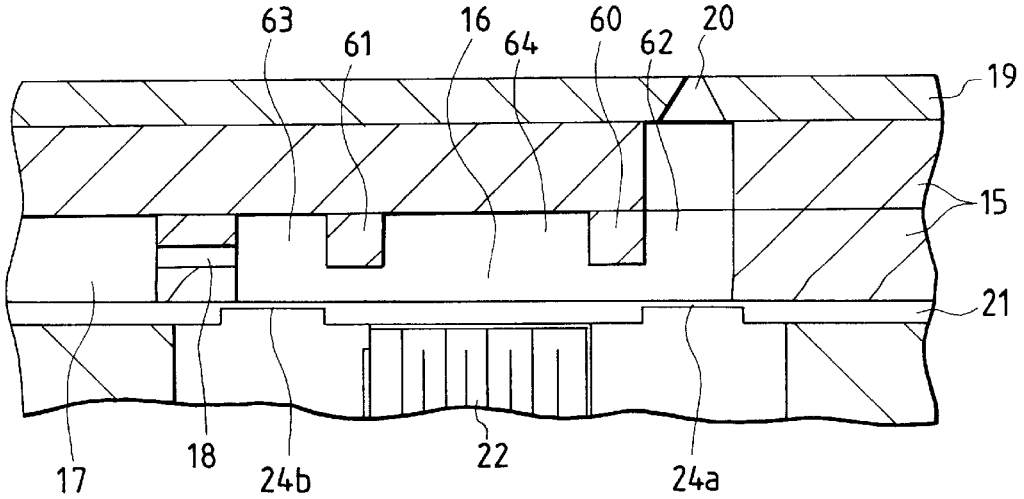
FIG. 14 is a sectional view showing another embodiment of an ink jet recording head suitable for the drive method of the invention with the neighborhood of a pressure producing chamber shown in enlarged form.

FIG. 14 shows another embodiment of an ink jet recording head to which the drive method of the invention is applicable. In this embodiment, nozzle opening side constricted portion 60 is formed between the nozzle opening side thin-walled portion 24*a* and the region directly displaced by the piezoelectric vibrator 22. Also, ink supply port side constricted portion 61 is formed between the ink supply port side thin-walled portion 24*b* and the region directly displaced by the piezoelectric vibrator 22. Constricted portions 60, 61 define separated regions 62, 63. Separated region 62 produces the compliance Cc1 on the nozzle opening side, and separated region 63 produces the compliance Cc2 on the ink supply port side. The separated regions 62, 63 are separated, to an extent, from a compliance derived from central region 64 by the constricted portions 60, 61. Because of this separation from the compliance of the central region 64, the aforementioned two vibration modes can function positively.

Figure 15:
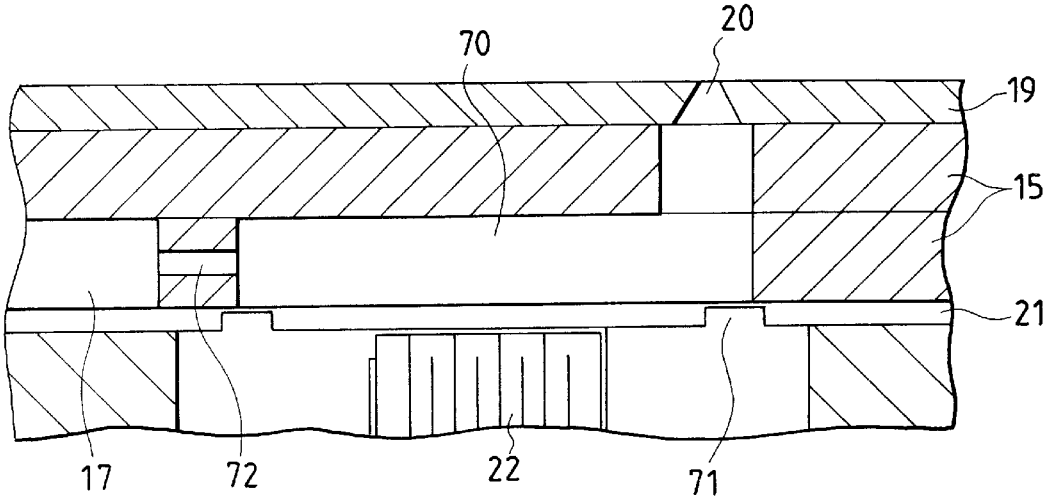
FIG. 15 is a sectional view showing another embodiment of an ink jet recording head suitable for the drive method of the invention with the neighborhood of a pressure producing chamber shown in enlarged form.

FIG. 15 shows another embodiment of a recording head of the invention. In this embodiment, an inertance Mc' of a pressure producing chamber 70 is adjusted so as to be substantially equal to the inertance Mn of a nozzle opening 20, so that the meniscus is caused to move substantially at a single vibration mode. Further, the flexibility of a thin-walled portion 71 of an elastic plate 21 that forms the pressure producing chamber 70 is adjusted, so that the meniscus can have an optimal natural vibration frequency.

Specifically, the nozzle opening 20 has an aperture of 32 $\mu$m, a straight portion length of 15 $\mu$m, an inertance Mn' of $8\times10^7$ (kg/m$^4$) when a tapered portion is added to the straight portion. Further, a rectangular ink supply port 72 has a cross section of 40 $\mu$m×50 $\mu$m, a length of 300 $\mu$m, and an inertance Ms' of $21\times10^7$ (kg/m$^4$). Further, the pressure producing chamber 70 rectangular, has a cross section of 40×100 $\mu$m, a length of 500 $\mu$m, and an inertance Ms' of $25\times10^7$ (kg/m$^4$).

Figure 16:
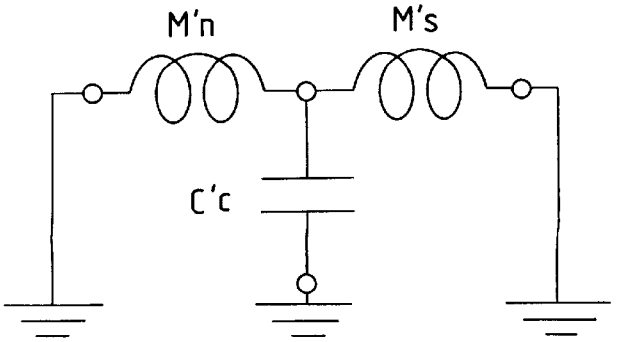
FIG. 16 is a diagram showing fluid characteristics of the aforementioned recording head in the form of a model.

The thus-constructed recording head can be expressed in the form of the equivalent electric circuit shown in FIG. 16. The Helmholtz resonance frequency of the pressure producing chamber 16 can be expressed as follows:

$$f = \frac{1}{2\pi}\sqrt{\frac{M_n' + M_s'}{C_c'(M_n' M_s')}}$$

In this embodiment, the Helmholtz resonance frequency is about 120 kHz, i.e., about 5 $\mu$s. It may be noted that a piezoelectric vibrator 22 is constructed in a manner similar to the above, so that the natural vibration frequency thereof is 450 kHz and the cycle thereof is about 2.2 $\mu$s.

Figure 17:
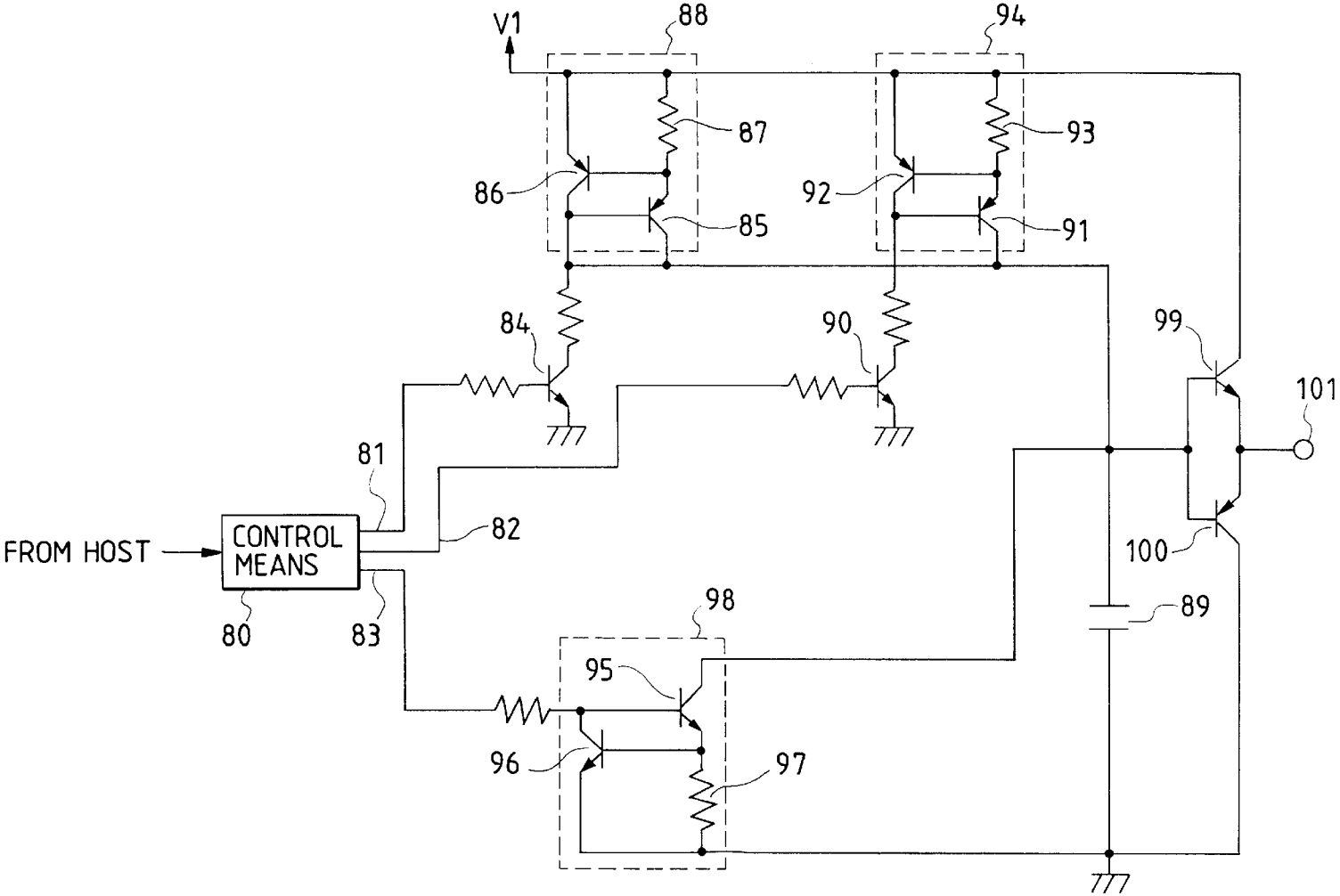
FIG. 17 is a circuit diagram showing an embodiment of a drive unit suitable for driving the aforementioned recording head.
Figure 18:
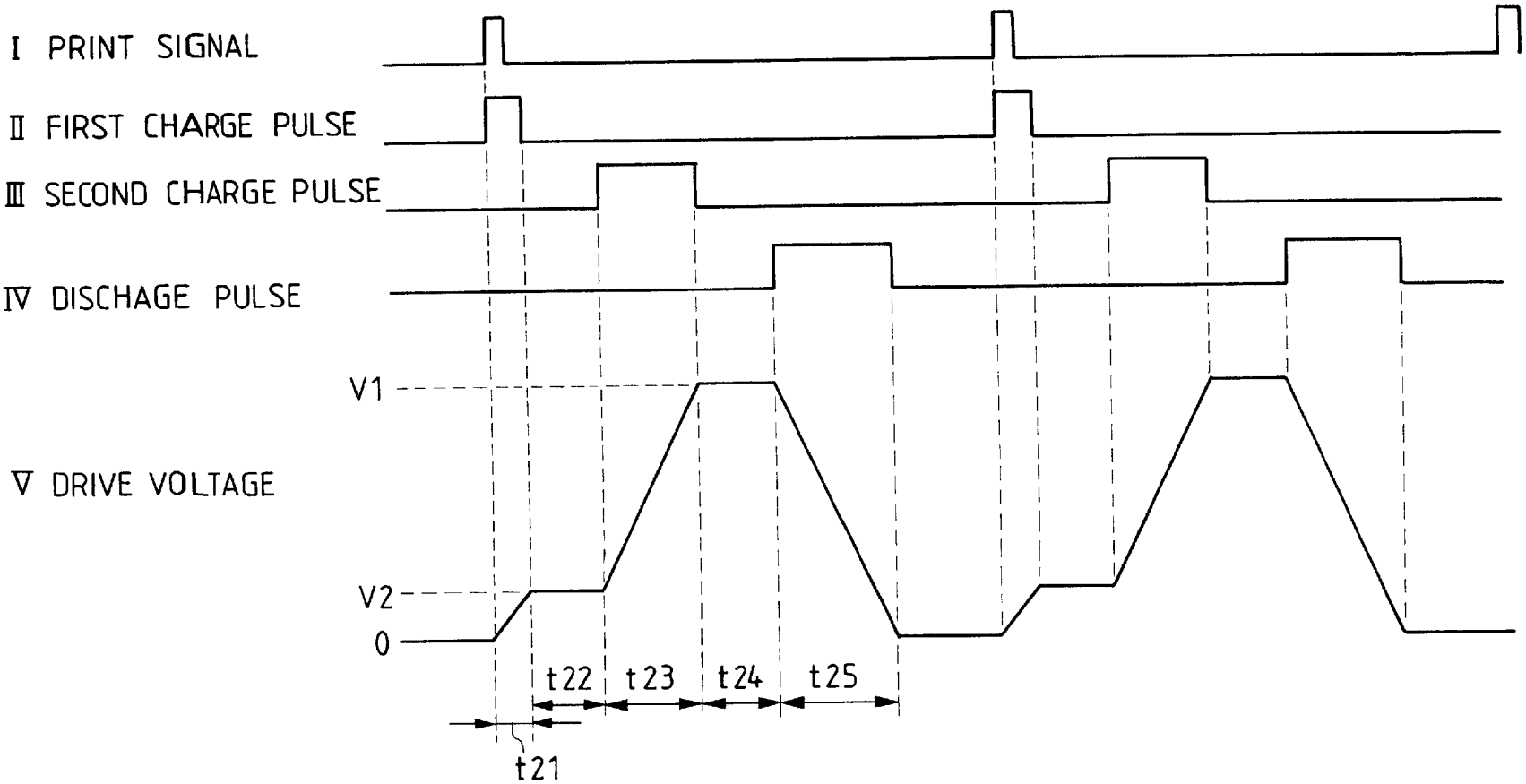
FIG. 18 is a waveform diagram showing signals of the aforementioned drive unit.

Referring now to FIGS. 17 and 18, FIG. 17 shows an embodiment of a drive circuit that drives the aforementioned recording head. In FIG. 17, reference numeral 80 denotes a control means, which is designed to output a first charge pulse (see FIG. 18(II)), a second charge pulse (FIG. 18(III)), and a discharge pulse (FIG. 18(IV)) from output terminals 81, 82, 83 in synchronism with a print signal based on print data from a host.

When a first charge pulse is applied to the base of an NPN transistor 84 to cause the NPN transistor 84 to conduct, a constant current circuit 88 having NPN transistors 85, 86 and a resistor 87 operates, thereby charging a capacitor 89 to a second voltage V2 at a predetermined current Ira suitable for drawing a meniscus.

Similarly, when a second charge pulse outputted from the terminal 82 is applied to the base of an NPN transistor 90 to cause the NPN transistor 90 to conduct, a constant current circuit 94 having NPN transistors 91, 92 and a resistor 93 operates, thereby additionally charging the capacitor 89 to a voltage V1 from voltage V2 at a predetermined current Irb suitable for drawing the meniscus rapidly and thereafter causing the voltage V1 to be held for a predetermined time.

On the other hand, when a discharge pulse is applied to the input terminal 83, a constant current circuit 98 having NPN transistors 95, 96 and a resistor 97 discharges the charges stored in the capacitor 89 to a zero voltage at a predetermined current Ifa suitable for jetting out an ink droplet. It may be noted that NPN transistors denoted as reference numerals 99, 100 constitute a current amplifier and applies a current suitable for driving a piezoelectric vibrator to an output terminal 101.

An operation of the thus constructed apparatus will be described next.

When a print command is applied to the control means 80 from the host, the control means 80 applies the first charge signal (FIG. 18(II)) whose time width is t21 to the terminal 81 in synchronism with a print signal (FIG. 18(I)). The piezoelectric vibrator 22 is charged to the voltage V2 at a constant gradient for the time t21 at the predetermined current Ira by the constant current circuit 88, so that the piezoelectric vibrator 22 contracts at a predetermined speed, which in turn causes the corresponding pressure producing chamber 16 to expand at a predetermined speed.

As a result, the meniscus m, shown stationary at the nozzle opening 20 in FIG. 11(I), is radically drawn toward the pressure producing chamber, and starts vibrating at its own natural vibrating frequency. At this time, a meniscus portion that is closer to the central region is selectively drawn toward the pressure producing chamber more than the region having the thickness δ from the wall surface of the nozzle opening 20 in which the ink is largely viscous as described above (FIG. 11(II)).

The control means 80 holds the voltage V2 only for a time t22 at the stage where the piezoelectric vibrator 22 has been charged to the voltage V2, and prevents capacity change of the pressure producing chamber 16 to an extent possible. When the pressure vibration of the meniscus has been reversed from negative to positive, an outward stream (arrows A as viewed in FIG. 11(III)) is produced in the boundary layer portion of the meniscus, whereas the central region of the meniscus is still drawn toward the pressure producing chamber (FIG. 11(III)). With the boundary layer portion pushed out toward the nozzle opening as time elapses, the meniscus is transformed so that the central portion thereof is more largely displaced toward the pressure producing chamber (FIG. 11(III)).

The control means 80 outputs a second charge pulse (FIG. 18(III)) after a predetermined time elapses. The piezoelectric vibrator 22 is charged to the voltage V1 at a predetermined gradient for a time t23 at the predetermined current Irb by the constant current circuit 94, so that the piezoelectric vibrator 22 contracts largely at a predetermined speed, which in turn causes the pressure producing chamber 16 to further expand at a predetermined speed. As a result, since the inertance is relatively small compared with the boundary layer in the central region of the nozzle opening 20 because of the smaller amount of ink in such region, only the central region mc of the nozzle opening 20 is selectively and rapidly drawn toward the pressure producing chamber (FIG. 11(IV)).

Thus, at the stage where the central region of the meniscus is strongly drawn toward the pressure producing chamber, the control means 80 outputs a discharge pulse (FIG. 18(IV)) from the terminal 83. The piezoelectric vibrator 22 is discharged for a time t25 at the predetermined current Ifa from the constant current circuit 98, so that the piezoelectric vibrator 22 radically expands at a predetermined speed, which in turn causes the pressure producing chamber 16 to contract at a predetermined speed.

An ink stream pressured at the pressure producing chamber 16 due to the contraction of the pressure producing chamber 16, i.e., an inertial stream, intensively acts upon the central region mc of the meniscus m close to the pressure producing chamber side (FIG. 11(V)), pushing only the central region mc of the meniscus m out at a very great speed (FIG. 11 (VI)). Since the central region of the meniscus is positively pressured without recourse solely to the movement of the meniscus itself this way, a slender ink droplet whose diameter is smaller than the diameter of the nozzle opening 20 can be jetted out of the nozzle opening 20 stably at a speed suitable for printing.

Then, when the voltage of the piezoelectric vibrator 22 is zeroed, a next print signal is waited for, and every time a print signal is inputted, the aforementioned process is repeated so that dots are formed.

By the way, since the drawing of a meniscus as the first step (FIG. 11(I)) in this embodiment is a process that produces a boundary layer between the meniscus and the wall of nozzle opening 20, it is desired that the meniscus be drawn by a small amount. On the other hand, since the second step (FIG. 11(IV)) is a process for making the inertance derived from the central portion of the meniscus kinetically small, and for causing the following inertial stream of ink strongly to act, it is more effective that the meniscus be drawn by a larger amount. Therefore, V2 should be less than V1–V2. Advantageously, the ratio of the charge voltage V2 of the piezoelectric vibrator 22 to the additional charge voltage V1–V2 is 1:3, more preferably to 1:4, or still more desirably to 1:6 or greater.

It was experimentally further verified that it is effective to set the first rising time t21 and the second rising time t23 to values smaller than the natural vibration cycle of the piezoelectric vibrator 22. Thus, in this embodiment, the time t21+t23 is set to 2 μs to 3 μs. Further, if the falling time t25 for the jetting of an ink droplet is set to a value smaller than or, preferably, equal to the natural vibration frequency of the piezoelectric vibrator 22 in a manner similar to the aforementioned embodiment, residual vibrations can be prevented.

Specifically, when the recording head is driven by setting the final saturation voltage V1 to 20 V, and the first step charge voltage V2 is set to 3V–5V, and the falling time t25 for the jetting of an ink droplet is set to 2_μs–4 μs, an ink droplet whose weight is from about 5 ng–7 ng could be jetted out at a speed ranging from 10 m/s–15 m/s.

In contrast thereto, according to the conventional drive method in which the piezoelectric vibrator 22 is charged from 0V to V1 continuously, ink droplet jetting speed was reduced to half, i.e., 4 m/s to 8 m/s, although the weight of the ink droplet remained almost the same.

It is to be noted that-the hold time t22 determines a time difference between the first rising end and the second rising start, and is an important factor. By setting the hold time t22 to about half (2 μs to 3 μs) the vibration cycle (5 μs in this embodiment) of the meniscus (defined by the Helmholtz resonance frequency of the pressure producing chamber 70), the amount of ink in an ink droplet is reduced, increasing the flying speed of the ink droplet.

In contrast thereto, if the hold time t22 is set to a larger value, not only does the amount of an ink droplet increase, but also the flying speed thereof is reduced. This, in turn, makes it impossible to achieve the originally expected goal. This is because the increased hold time compels the meniscus to be drawn for a second time just when the meniscus drawn by the first step charging operation is returning toward the nozzle opening. That is, the meniscus drawing force is canceled out by the movement of the meniscus itself as it projects toward the nozzle opening. Therefore, when the hold time t22 is increased, the aforementioned effect of giving a time-dependent change in pressure gradient (i.e., the stream having a phase π/2 behind the phase of the vibration) cannot be utilized, even though the stream vibrates as a single body while strongly affected by inertia in the central region instead of in the boundary layer. In other words, it is essential that the second step meniscus drawing operation be implemented within a time shorter than a single cycle of a vibration of the meniscus after-the meniscus has been drawn by the first step charging operation.

Figure 19A:
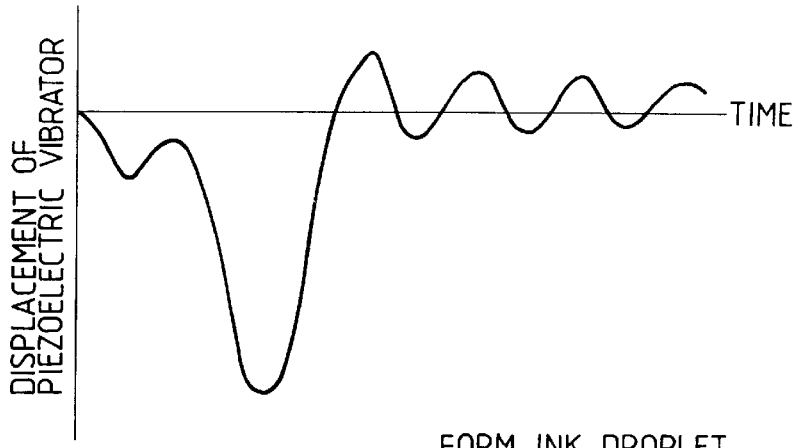
FIG. 19 includes diagrams 19(*a*) and 19(*b*) showing a time-dependent change in the displacement of a piezoelectric vibrator and a time dependent change in the displacement of the central portion of a meniscus, both changes being produced by a second drive method of the invention.
Figure 19B:
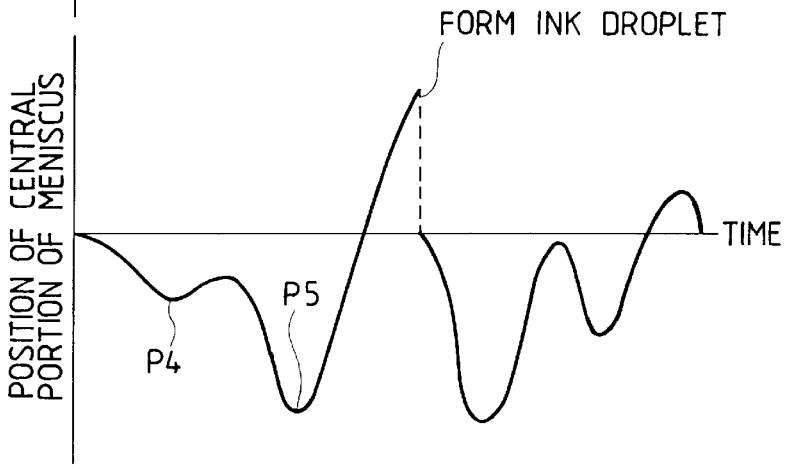

FIG. 19 is a diagram showing a relationship between the displacement of a piezoelectric vibrator 22 and the position of the central portion of a meniscus in the aforementioned drive method. In particular, FIG. 19(*a*) shows the displacement of the piezoelectric vibrator over time, and FIG. 19(*b*) depicts the center region of the meniscus at the same times.

As FIG. 19 shows, the meniscus is drawn by the contraction of the piezoelectric vibrator 22 caused by the first step charging operation. The meniscus then returns by a displacement that is smaller than the amount drawn. When this happens, the piezoelectric vibrator 22 is further contracted so as strongly to draw the meniscus. When the vibration of the meniscus caused by this drawing operation is reversed, and causes the meniscus to start moving toward the nozzle opening 20, the piezoelectric vibrator 22 is discharged, so that an ink droplet is jetted.

Thus, it is clear that pressure is applied to the pressure producing chamber 16 when the central portion of the meniscus comes closest to the pressure producing chamber and when the central portion starts moving toward the nozzle opening. Therefore, an ink droplet can be jetted with a reduced amount of ink but with the flying speed thereof not decreased.

Figure 20:
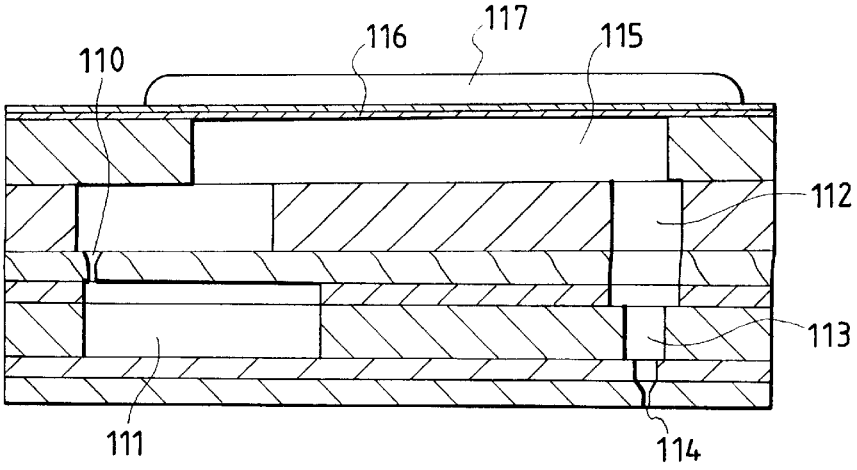
FIG. 20 is a diagram showing another embodiment of an ink jet recording head to which the recording method of the invention is applicable.

While a piezoelectric vibrator that is displaced along the length thereof has been taken as an example in the aforementioned embodiment, similar advantages can be obtained by applying the invention to the following recording head. As shown in FIG. 20, the invention may be applicable to a recording head that is constructed in such a manner that a reservoir 111 and part of a pressure producing chamber 115 communicating with a nozzle opening 114 through nozzle communication holes 112, 113 are sealed by an elastically deformable cover body 116 through an ink supply port 110; and a piezoelectric vibrator 117 that is displaced in a flexural mode is stuck to a surface of the cover body 116, or formed by sputtering a piezoelectric material onto the surface of the cover body 116.

As described in the foregoing, the invention involves a first step of expanding a pressure producing chamber so that the central region of the meniscus, and not the wall region of the meniscus, is selectively drawn toward the pressure producing chamber. The invention also involves a second step of contracting the pressure producing chamber at a speed that jets an ink droplet. By selectively applying pressure only to the central region of the meniscus, an ink droplet having a small amount of ink can be jetted not only at a flying speed suitable for printing, but also with the effects of viscosity of the ink decreased to a maximum possible extent.

We claim:

1. A recording method for an ink jet recording apparatus, said ink jet recording apparatus having a pressure producing chamber communicating with a nozzle opening and an ink supply port, said nozzle opening having a wall surface, said ink jet recording apparatus further having an ink reservoir supplying ink through said ink supply port and said pressure producing chamber to said nozzle opening, said supplied ink being disposed in said nozzle opening having a meniscus with a central meniscus portion and a wall side meniscus portion, said ink jet recording apparatus further having a piezoelectric vibrator that exerts pressure on said pressure producing chamber, said method comprising the steps of:

expanding said pressure producing chamber so that said central meniscus portion is drawn toward said pressure producing chamber by a first displacement of said piezoelectric vibrator for a first tine interval, and so that said wall side meniscus portion is not drawn when said central meniscus portion is drawn, wherein the central meniscus portion is selectively drawn by drawing the meniscus two or more times; and contracting said pressure producing chamber by a second displacement of said piezoelectric vibrator for a second time interval at a speed that pushes substantially only said central meniscus portion thereby causing an ink droplet to be jetted from said nozzle opening.

2. The recording method according to claim 1, wherein said second time interval is begun when said central meniscus portion reverses toward said nozzle opening.

3. The recording method according to claim 1, wherein said expanding step is performed so as to cause said meniscus to move at at least two different natural vibration frequencies of said meniscus.

4. The recording method according to claim 1, wherein said expanding step comprises the steps of:

in a first expansion, displacing said piezoelectric vibrator by a first part of said first displacement for a first part of said first time interval; and in a second expansion, displacing said piezoelectric vibrator by a second part of said first displacement for a second part of said first time interval;

whereby said central meniscus portion is consecutively drawn twice before said contracting step is performed.

5. The recording method according to claim 4, wherein a time interval between said first expantion and said second expantion are less than or equal to a natural vibration cycle of said meniscus.

6. The recording method according to claim 5, wherein a ratio of said first part of said first displacement to said second part of said first displacement is at least 1:3.

7. The recording method according to claim 6, wherein said ratio is in a range of 1:3 to 1:6, inclusive.

8. The recording method according to claim 1, wherein said first time interval and said second time interval each have a respective duration less than or equal to a natural vibration cycle of said meniscus.

9. A recording method for an ink jet recording apparatus, said ink jet recording apparatus having a pressure producing chamber communicating with a nozzle opening and an ink supply port, said nozzle opening having a wall surface, said ink jet recording apparatus further having an ink reservoir supplying ink through said ink supply port and said pressure producing chamber to said nozzle opening, said supplied ink being disposed in said nozzle opening having a meniscus with a central meniscus portion and a wall side meniscus portion, said ink jet recording apparatus further having a piezoelectric vibrator that exerts pressure on said pressure producing chamber, said method comprising the steps of expanding said pressure producing chamber so that said central meniscus portion is drawn toward said pressure producing chamber by a first displacement of said piezoelectric vibrator for a first time interval, and so that said wall side meniscus portion is not drawn when said central meniscus portion is drawn; and contracting said pressure producing chamber by a second displacement of said piezoelectric vibrator for a second time interval at a speed that causes an ink droplet to be jetted from said nozzle opening, wherein said second time interval is begun when said central meniscus portion reverses toward said nozzle opening.

10. A recording method for an ink jet recording apparatus, said ink jet recording apparatus having a pressure producing chamber communicating with a nozzle opening and an ink supply port, said nozzle opening having a wall surface, said ink jet recording apparatus further having an ink reservoir supplying ink through said ink supply port and said pressure producing chamber to said nozzle opening, said supplied ink being disposed in said nozzle opening having a meniscus with a central meniscus portion and a wall side meniscus portion, said ink jet recording apparatus further having a piezoelectric vibrator that exerts pressure on said pressure producing chamber, said method comprising the steps of:

expanding said pressure producing chamber so that said central meniscus portion is drawn toward said pressure producing chamber by a first displacement of said piezoelectric vibrator for a first time interval, and so that said wall side meniscus portion is not drawn when said central meniscus portion is drawn; and contracting said pressure producing chamber by a second displacement of said piezoelectric vibrator for a second time interval at a speed that causes an ink droplet to be jetted from said nozzle opening, wherein said expanding step is performed so as to cause said meniscus to move at least two different natural vibration frequencies of said meniscus.

11. A recording method for an ink jet recording apparatus, said ink jet recording apparatus having a pressure producing chamber communicating with a nozzle opening and an ink supply port, said nozzle opening having a wall surface, said ink jet recording apparatus further having an ink reservoir supplying ink through said ink supply port and said pressure producing chamber to said nozzle opening, said supplied ink being disposed in said nozzle opening having a meniscus with a central meniscus portion and a wall side meniscus portion, said ink jet recording apparatus further having a piezoelectric vibrator that exerts pressure on said pressure producing chamber, said method comprising the steps of:

expanding said pressure producing chamber so that said central meniscus portion is drawn toward said pressure producing chamber by a first displacement of said piezoelectric vibrator for a first time interval, and so that said wall side meniscus portion is not drawn when said central meniscus portion is drawn; and contracting said pressure producing chamber by a second displacement of said piezoelectric vibrator for a second time interval at a speed that causes an ink droplet to be jetted from said nozzle opening, wherein said expanding step further comprises the steps of: displacing said piezoelectric vibrator in a first expansion by a first part of said first displacement for a first part of said first time interval; and displacing said piezoelectric vibrator in a second expansion by a second part of said first displacement for a second part of said first time interval, whereby said central meniscus portion is consecutively drawn twice before said contracting step is performed.

12. The recording method according to claim 11, wherein a time interval between said first expansion and said second expansion are less than or equal to a natural vibration cycle of said meniscus.

13. The recording method according to claim 12, wherein a ratio of said first part of said first displacement to said second part of said first displacement is at least 1:3.

14. The recording method according to claim 13, wherein said ratio is in a range of 1:3 to 1:6, inclusive.

15. A recording method for an ink jet recording apparatus, said ink jet recording apparatus having a pressure producing chamber communicating with a nozzle opening and an ink supply port, said nozzle opening having a wall surface, said ink jet recording apparatus further having an ink reservoir supplying ink through said ink supply port and said pressure producing chamber to said nozzle opening, said supplied ink being disposed in said nozzle opening having a meniscus with a central meniscus portion and a wall side meniscus portion, said ink jet recording apparatus further having a piezoelectric vibrator that exerts pressure on said pressure producing chamber, said method comprising the steps of:

expanding said pressure producing chamber so that said central meniscus portion is drawn toward said pressure producing chamber by a first displacement of said piezoelectric vibrator for a first time interval, and so that said wall side meniscus portion is not drawn when said central meniscus portion is drawn; and contracting said pressure producing chamber by a second displacement of said piezoelectric vibrator for a second time interval at a speed that causes an ink droplet to be jetted from said nozzle opening, wherein said first time interval and said second time interval each have a respective duration less than or equal to a natural vibration cycle of said meniscus.

16. A recording method for an ink jet recording apparatus, said ink jet recording apparatus having a pressure producing chamber communicating with a nozzle opening and an ink supply port, said nozzle opening having a wall surface, said ink jet recording apparatus further having an ink reservoir supplying ink through said ink supply port and said pressure producing chamber to said nozzle opening, said supplied ink being disposed in said nozzle opening having a meniscus with a central meniscus portion and a wall side meniscus portion, said ink jet recording apparatus further having a piezoelectric vibrator that exerts pressure on said pressure producing chamber, said method comprising the steps of:

expanding said pressure producing chamber so that said central meniscus portion is drawn toward said pressure producing chamber by a first displacement of said piezoelectric vibrator for a first time interval, and so that said wall side meniscus portion is not drawn when said central meniscus portion is drawn; and contracting said pressure producing chamber by a second displacement of said piezoelectric vibrator for a second time interval at a speed that pushes substantially only said central meniscus portion thereby causing an ink droplet having a diameter that is smaller than a diameter of said nozzle opening to be jetted from said nozzle opening.

* * * * *